US005275224A

United States Patent [19]

Morris

[11] Patent Number: 5,275,224

[45] Date of Patent: Jan. 4, 1994

[54] CORNER BRACKET FOR A FABRIC SUPPORT TRACK ASSEMBLY

[76] Inventor: Milton A. Morris, 11942 Sherman Rd., North Hollywood, Calif. 91605

[21] Appl. No.: 989,135

[22] Filed: Dec. 11, 1992

[51] Int. Cl.[5] ..... A47H 1/00; E04F 13/00; E04B 2/88

[52] U.S. Cl. ..... 160/327; 160/381; 52/222

[58] Field of Search ..... 160/327, 380, 381, 328; 52/273, 222

[56] References Cited

U.S. PATENT DOCUMENTS 4,018,260 4/1977 Baslow .
4,053,008 11/1977 Baslow .
4,151,762 5/1979 Baslow .
4,161,977 7/1979 Baslow .
4,197,686 4/1980 Baslow .
4,201,359 5/1980 Baslow .
4,403,642 9/1983 Morris ..... 160/380
4,625,490 12/1986 Baslon ..... 160/327 X
4,676,016 6/1987 Phillips et al. .
4,986,332 1/1991 Lanuza ..... 160/327

*Primary Examiner*—Blair M. Johnson
*Attorney, Agent, or Firm*—Kelly, Bauersfeld & Lowry

[57] ABSTRACT

A corner bracket is provided for use with a fabric supporting track assembly of a type adapted for installation of a fabric wall covering onto a wall. The corner bracket has a generally triangular configuration defining a generally L-shaped corner piece hingedly connected to a bracket base adapted for fixed attachment to the wall. The bracket base supports the corner piece within a corner of the wall, in alignment with horizontal and vertical components of the track assembly. The corner piece is hingedly movable between an easily accessed first position pivoted away from the wall corner for facilitated attachment of the fabric wall covering thereto, and a second position pressed into the wall corner for snap-fit interlock with the track components.

19 Claims, 3 Drawing Sheets

FIG. 1
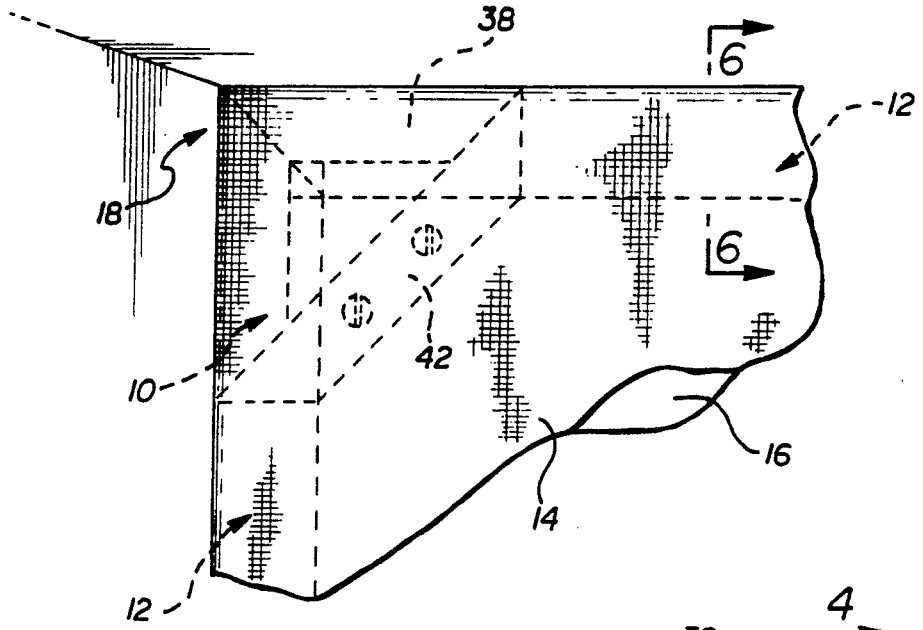
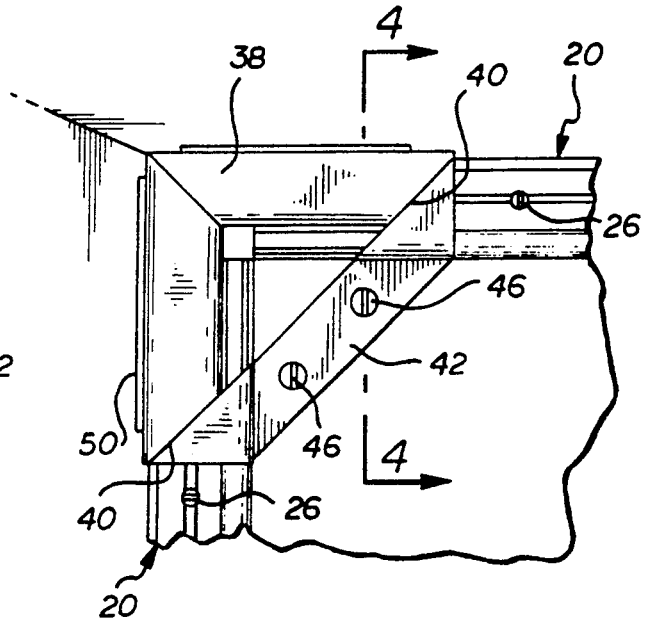
FIG. 2
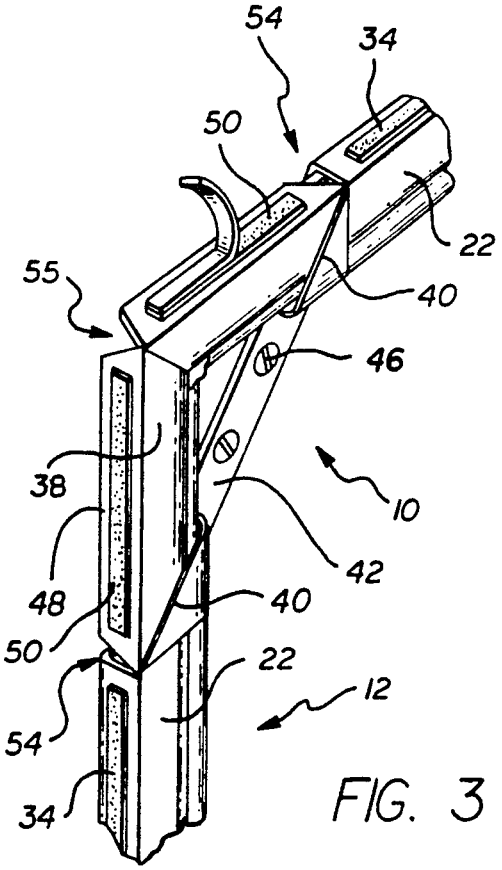
FIG. 3

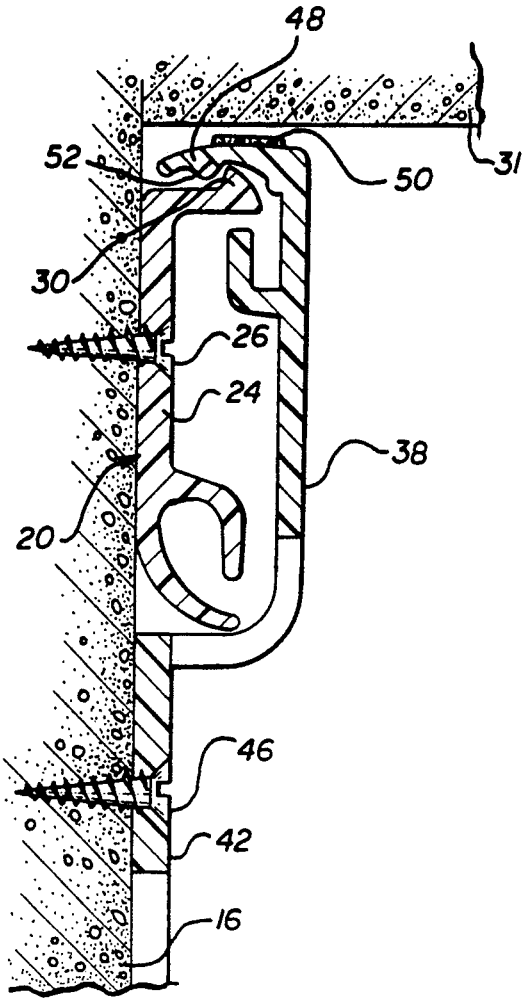
FIG. 4
FIG. 5
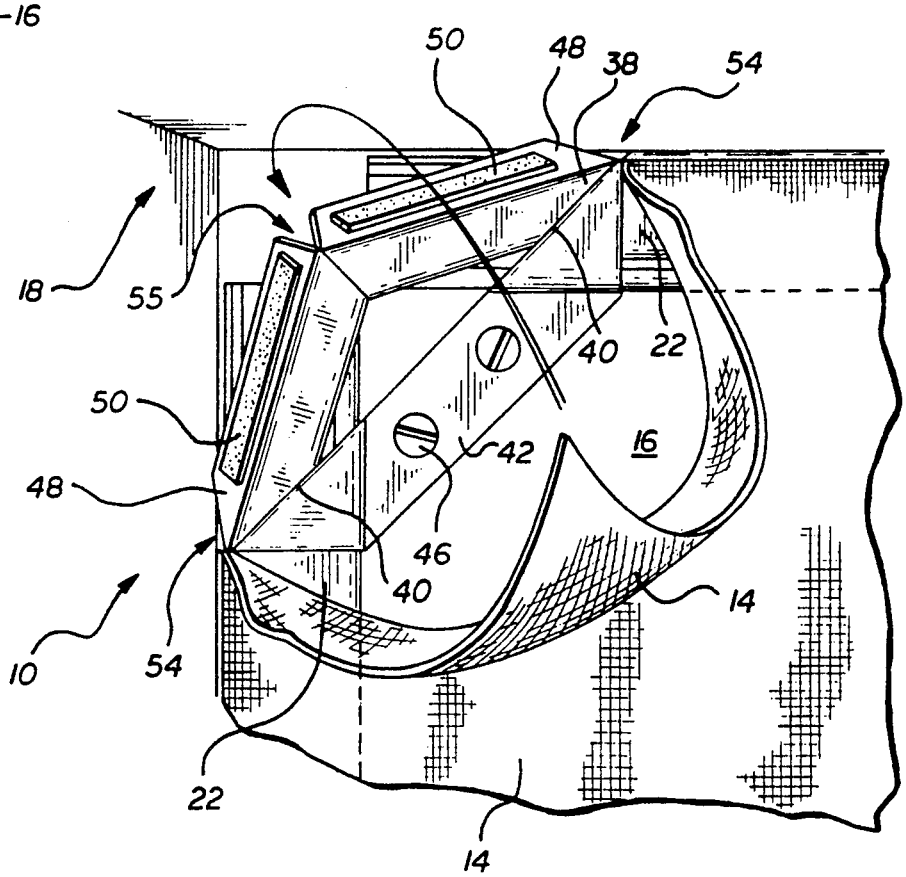

CORNER BRACKET FOR A FABRIC SUPPORT TRACK ASSEMBLY

BACKGROUND OF THE INVENTION

This invention relates generally to devices and systems for installing a wall covering of fabric material or the like onto a wall of a building, particularly through the use of a supporting track or frame which retains the wall covering material in an attractive and relatively taut condition. More specifically, this invention relates to an improved corner bracket for use with fabric supporting frames or tracks, to achieve facilitated and attractive installation of the wall covering material at a wall corner.

Fabric supporting tracks or frames are generally known in the art for use in supporting and retaining a fabric wall covering or the like on a wall of a building. Such structures typically comprise elongated track components adapted for secure mounting onto the building wall, and including means for supporting and tensioning the fabric material to provide an attractive wall covering. Such wall coverings are particularly desirable on rough and/or unfinished interior walls, since the tensioned fabric material provides an attractive and flat finished appearance despite the presence of roughened or otherwise unfinished and/or unprepared surfaces of the underlying wall structure. For examples of frame-supported fabric wall covering systems, see U.S. Pat. Nos. 4,018,260; 4,053,008; 4,151,762; 4,161,977; 4,197,686; and 4,676,016.

A preferred fabric supporting track assembly for use in installation of a fabric wall covering is disclosed in U.S. Pat. No. 4,403,642. More particularly, the track assembly comprises track base strips adapted for secure attachment to the wall along the marginal edges thereof, wherein the track base strips hingedly interfit with overlying fabric support strips adapted for attachment to the fabric wall covering material. The fabric support strips hingedly rotate toward snap-fit interlock with the underlying track base strips to support and retain the fabric wall covering in a tensioned manner on the wall. The snap-fit interlock between the fabric support and track base strips is designed to capture and conceal the marginal edges of the fabric material.

One disadvantage encountered with existing fabric support tracks or frames, as described above, relates to installation of the fabric material into a wall corner in a neat and attractive manner. In the past, it has generally been necessary for the track or frame components to be cut for purposes of defining mitered corners. However, accurate formation of mitered cuts requires a considerable degree of skill. Moreover, each corner of the track or frame is difficult to access for purposes of manipulating the fabric wall covering material to provide the desired uniformly tensioned fabric surface, without wrinkles or other distortions at the corners of the wall.

There exists, therefore, a need for improvements in supporting frames or tracks for fabric wall coverings and the like, particularly with respect to facilitated and simplified fabric installation in a neat and attractive manner into each corner of a wall. The present invention fulfill these needs and provides further related advantages.

SUMMARY OF THE INVENTION

In accordance with the invention, a corner bracket is provided for use with a fabric support track assembly for retaining and supporting a fabric wall covering or the like on the wall of a building. The corner bracket cooperates with the track assembly to support and retain the wall covering in a neat and attractive, substantially uniformly tensioned manner, wherein the wall covering can be installed quickly and easily into each corner of the wall without requiring special or professional installation skills. The corner bracket comprises an L-shaped corner piece connected hingedly to a bracket base adapted for rigid or secure attachment to the building wall, wherein the corner piece can be pivoted away from the adjacent wall corner for facilitated mounting of the wall covering thereto, followed by simple press-fit displacement of the corner piece into the wall corner in snap-fit interlock relation with other components of the fabric support track assembly.

In the preferred form, the corner bracket is adapted for use with a fabric support track assembly of the type described in U.S. Pat. No. 4,403,642. More specifically, the preferred track assembly includes elongated track base strips adapted for attachment to a selected wall to extend along the marginal edges thereof. Fabric support strips are hingedly engageable with the track base strips and include adhesive means along the marginal edges thereof for connection to a fabric wall covering. The fabric support strips are hingedly movable toward overlying relation with the track base strips, in snap-lock engagement therewith, to stretch and support the fabric wall covering on the wall.

The corner bracket of the present invention has a generally triangular configuration for mounting into a corner of the wall, in a position overlying the adjacent ends of horizontally and vertically extending track base strips. The corner bracket includes a bracket base extending angularly between the adjacent track base strips, and adapted for rigid or secure attachment to the building wall. The L-shaped corner piece is hingedly connected to the bracket base for pivoting movement away from the wall corner for facilitated manual access thereto and correspondingly facilitated assembly of the fabric wall covering therewith. The corner piece is then movable to a position substantially flush with the building wall, at the corner thereof, in snap-lock engagement with the track base strips. In the preferred form, the corner bracket is constructed as a unitary plastic molding, with the corner piece connected to the bracket base by means of a living hinge.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented sectional view illustrating a wall covering supported on a wall of building by means of a support track assembly, in combination with a corner bracket embodying the novel features of the invention;

FIG. 2 is an enlarged fragmented perspective view similar to FIG. 1, and illustrating installation of the corner bracket into the corner of a building wall in combination with horizontal and vertical components of the support track assembly;

FIG. 3 is a perspective view illustrating the corner bracket and support track assembly of FIG. 1, with fabric wall covering removed;

FIG. 4 is an enlarged fragmented vertical sectional view taken generally on the line 4—4 of FIG. 2;

FIG. 5 is an enlarged fragmented perspective view similar to FIG. 1, and illustrating manipulation of the corner bracket for facilitated attachment of the fabric wall covering thereto;

DETAILED DESCRIPTION OF THE PREFERRED EMBODIMENT

Figure 6:
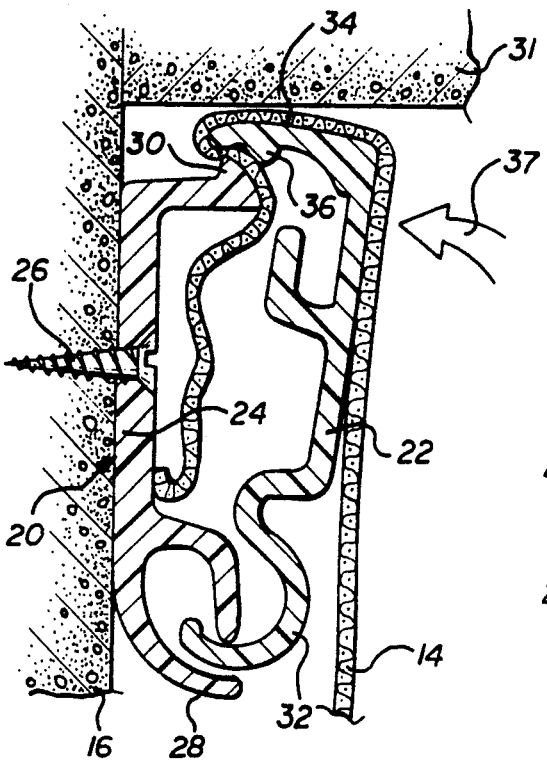
FIGS. 6 and 7 are enlarged fragmented vertical sectional views taken generally on the line 6—6 of FIG. 1, and illustrating manipulation of the preferred support track assembly for installing the fabric wall covering onto the wall.

As shown in the exemplary drawings, an improved corner bracket referred to generally by the reference numeral 10 is provided for use with a fabric support track assembly 12 to mount a fabric wall covering 14 or the like onto a wall 16 of a building. The corner bracket 10 facilitates installation of the wall covering 14 in a neat and attractive manner, and in a substantially uniformly tensioned condition, into each corner 18 of the building wall.

The corner bracket 10 of the present invention is particularly designed for use with a fabric support track assembly 12, of the type disclosed in U.S. Pat. No. 4,403,642, which is incorporated by reference herein. That track assembly 12 generally comprises a plurality of track base strips 20 (FIGS. 2, 6 and 7) mounted along the peripheral margins of the selected building wall 16, in combination with overlying fabric support strips 22. The fabric support strips 22 are adapted for hinged and snap-fit interlock engagement with the base strips 20 to retain and support the wall covering 14 in a flat and substantially wrinkle-free tensioned configuration on the building wall 16.

Figure 7:
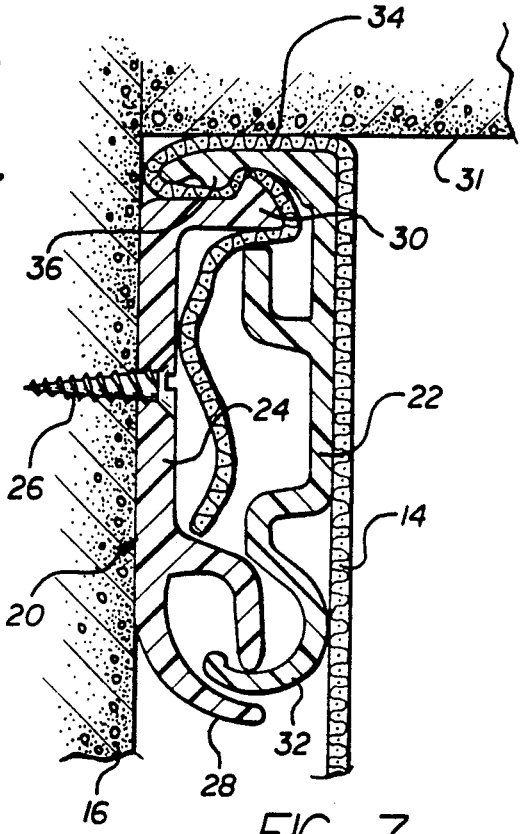

More particularly, as shown best in FIGS. 2 and 6, the base strips 20 comprise elongated track components of extruded plastic material or the like defining a central mounting plate 24 adapted for secure and substantially flush attachment to the building wall 16 by means of a longitudinally spaced plurality of suitable fasteners 26. In this regard, a wide variety of fasteners of different type and style may used, depending upon the construction of the wall 16, such as drywall, plaster, wood, concrete block, etc. An inboard edge of each base strip 20 defines a hinge segment 28, whereas an outboard edge defines a snap-lock rib 30 protruding toward but spaced slightly from the adjacent wall such as the ceiling 31.

The fabric support strips 22 are also conveniently constructed as plastic extrusions and include a hinge segment 32 along an inboard edge thereof for assembly with the corresponding hinge segment 28 on the base strip 20. Adhesive means 34 such as a length of double-sided tape is carried at or near an outboard edge of the fabric support strip 22 for adhesive attachment with the wall covering 14, near a marginal edge of the wall covering. A free end of the wall covering is wrapped over a snap-lock finger 36 at the outboard edge of the fabric support strip 22, wherein the finger 36 is positioned for snap-lock interengagement with the rib 30 on the base strip 20 as the support strip 22 is hingedly rotated as indicated by arrow 37 in FIG. 6 to a substantially flush position overlying the base strip 20 (FIG. 2). In the course of this movement, the wall covering 14 is tensioned to provide a generally uniform and attractive planar appearance supported in slightly spaced relation with the building wall 16. In this finished and locked position, the free marginal edge of the fabric wall covering is captured and retained in the space between the base and fabric support strips 20 and 22 of the track assembly.

The corner bracket 10 comprises a relatively simple structural component adapted for installation into the corner 18 of the wall 16, and functions in combination with the assembled components of the track assembly 12 to provide a neat and finished appearance at each wall corner. The bracket 10 may be conveniently and economically constructed from plastic materials by injection molding or the like.

As shown in FIGS. 2-5, the corner bracket 10 has a generally triangular configuration to include an L-shaped corner piece 38 coupled by means of a hinge 40 to a bracket base 42. The corner piece 38 is shaped to fit substantially flush into the wall corner 18, with the bracket base 42 extending angularly at about forty five degrees between adjacent ends of the horizontal and vertical track assembly components. The bracket base 42 includes a central segment shaped to seat flush against the building wall 16, for secure attachment thereto by means of one or more suitable fasteners 46. The opposite ends of the base 42 have a raised channel configuration to fit over the adjacent ends of the track assembly components, in close conformance therewith. When the corner bracket 10 is used with the track assembly described in U.S. Pat. No. 4,403,642, the raised ends of the bracket base 42 fit matingly over the underlying track base strips 20 which project into close proximity with each other in the corner of the wall. The track base strips 20 may be installed prior to attachment of the bracket base 42 to the wall 16, or otherwise slide-fitted through the bracket base ends subsequent to base attachment.

The corner piece 38 is separated from the bracket base 42 by the hinge 40, preferably in the form of a living hinge when the corner bracket 10 is constructed as a unitary plastic molding. The corner piece 38 has a generally channel-shaped profile, as viewed in FIG. 4, to overlie the horizontally and vertically extending base strips 20 of the track assembly 12. An outboard edge wall 48 of the carrier piece 38 conveniently carries adhesive means 50, such as double-sided tape, for attachment to the fabric wall covering 14.

Subsequent to installation of the corner bracket 10, the fabric wall covering 14 is installed onto the building wall 16, in a conventional manner, using the fabric support strips 22 in snap-fit interlock engagement with the base strips 20. In this regard, as viewed in FIGS. 3 and 5, the fabric support strips 22 are cut for substantial conformance with the opposite ends of the corner bracket 10. However, as noted above, the base strips 20 protrude beneath the corner bracket, whereby the snap-lock rib 30 is positioned for snap-fit engagement by a lock finger 52 on the inboard sides of the edge walls 48.

Figure 8:
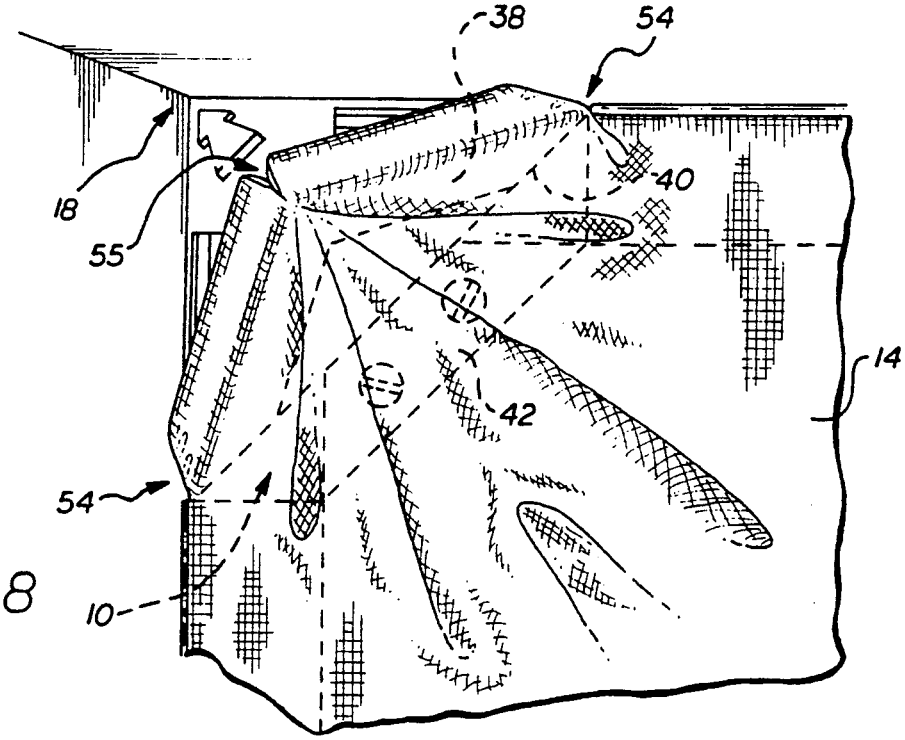
FIG. 8 is a fragmented perspective view similar to FIG. 5, and illustrating pivoting motion of a portion of the corner bracket with the fabric wall covering assembled thereto toward a finished and locked position as viewed in FIG. 1.

As shown in FIG. 5 and 8, the corner piece 38 can be pivoted via the hinge 40 in a direction away from the corner 18, for easy access and manipulation of the fabric material with respect thereto. In this regard, the opposite ends of the edge walls 48 are conveniently notched at positions adjacent the hinges 40, as indicated at 54, to facilitate pivoting movement of the corner piece, and corresponding assembly of the fabric wall covering 14 therewith. Moreover, the edge walls 38 desirably include an additional notch as indicated at 55, at the outboard corner thereof. When the wall covering is satisfactorily smoothed and adhesively attached with the corner piece 38, the corner piece is pivoted quickly and easily into the corner 18 for snap-lock engagement with the base strips 20 (FIGS. 1–4), thereby securely seating the fabric material in a neat and attractive, and uniformly tensioned manner. Excessive portions of the fabric material may be stuffed into the recesses defined by the edge wall notches 54 and 55 (FIG. 8), for facilitated installation.

The improved corner bracket 10 of the present invention thus functions in cooperation with a fabric support track assembly to facilitate an improved installation of a fabric wall covering into the corner of a building wall. The wall covering can be installed in a neat and attractive manner, without requiring significant or professional installation skills.

A variety of modifications and improvements to the invention described herein will apparent to those skilled in the art. For example, the outboard edges of the corner bracket 10 and the support track assembly 12 are shown with a generally squared-off appearance, it will be understood that these components may alternatively include a rounded or beveled shape. Accordingly, no limitation on the invention is intended by way of the foregoing description and accompanying drawings, except as set forth in the appended claims.

I claim:

1. A corner bracket for use with a fabric support track assembly having horizontal and vertical track components for supporting a fabric wall covering material on a wall, said corner bracket comprising:

a bracket base adapted for secure mounting onto a wall at a position in close proximity to a corner of the wall;

a generally L-shaped corner piece; and hinge means for hingedly supporting said corner piece from said bracket base for movement between a first position pivoted away from the wall corner and a second position pressed into said wall corner;

said corner piece including means for assembly with a fabric wall covering whereby assembly of the fabric wall covering is facilitated when said corner piece is in said first position, and whereby the fabric wall covering is tensioned upon movement of said corner piece to said second position;

said corner piece and said bracket base having a generally triangular shape, said hinge means permitting movement of said corner piece relative to said bracket base along an axis oriented at about forty five degrees to the horizontal and vertical track components at said wall corner.

2. The corner bracket of claim 1 wherein said bracket base, said corner piece, and said hinge means are formed as a unitary plastic molding said hinge means comprising a living hinge connected between said bracket base and said corner piece.

3. The corner bracket of claim 1 wherein said corner piece defines a generally L-shaped outboard edge wall having a plurality of notches formed therein.

4. The corner bracket of claim 1 further including fastener means for attachment of said bracket base to the wall.

5. The corner bracket of claim 1 wherein said bracket base includes opposite ends of raised channel shape to fit over the horizontal and vertical track components at said wall corner.

6. The corner bracket of claim 1 wherein said corner piece has a raised channel shape to fit over the horizontal and vertical track components at said wall corner.

7. The corner bracket of claim 1 wherein said corner piece includes means for releasible interlock engagement with the horizontal and vertical track components at said wall corner.

8. The corner bracket of claim 7 wherein said releasible interlock means comprises a snap-fit finger.

9. The corner bracket of claim 1 wherein said means for assembly with the fabric wall covering comprises adhesive means.

10. A corner bracket in combination with a fabric support track assembly having horizontal and vertical track components for supporting a fabric wall covering on a wall, said horizontal and vertical track components extending into close proximity with each other at a wall corner, said corner bracket comprising:

a bracket base adapted for secure attachment to the wall at a position near the corner thereof to extend angularly between the horizontal and vertical track components;

a generally L-shaped corner piece having means for attachment to the fabric wall covering; and living hinge means connected between said bracket base and said corner piece to permit movement of said corner piece between a first position spaced from the wall corner for facilitated attachment of the fabric wall covering thereto, and a second position pressed into the wall corner;

said corner piece including means for releasibly locking said corner piece in said second position.

11. The corner bracket of claim 10 further including fastener means for attachment of said bracket base to the wall.

12. The corner bracket of claim 10 wherein said bracket base includes opposite ends of raised channel shape to fit over the horizontal and vertical track components at said wall corner.

13. The corner bracket of claim 10 wherein said corner piece has a raised channel shape to fit over the horizontal and vertical track components at said wall corner.

14. The corner bracket of claim 13 wherein said releasible interlock means comprises a snap-fit finger.

15. The corner bracket of claim 10 wherein said means for assembly with the fabric wall covering comprises adhesive means.

16. The corner bracket of claim 10 wherein said corner piece defines a generally L-shaped outboard edge wall having a plurality of notches formed therein.

17. In combination:

a fabric support track assembly including horizontal and vertical track base strips adapted for attachment to a wall at the periphery thereof and to extend into close proximity with each other at a wall corner, each of said track base strips including a first hinge segment at an inboard edge thereof and a first lock member at an outboard edge thereof, said track assembly further including horizontal and vertical fabric support strips having means for attachment to a fabric wall covering, each of said fabric support strips including a second hinge segment at an inboard edge thereof and a second lock member at an outboard edge thereof;

said first and second hinge segments of said track base and fabric support strips being interengageable to permit rotation of said fabric support strips with the fabric wall covering attached thereto between a first position with the outboard edges thereof spaced from the wall and a second position with said first and second lock members interengaged; and a corner bracket including a bracket base adapted for secure mounting onto the wall near said wall corner, and a generally L-shaped corner piece hinged to said bracket base for movement between a first position spaced from said wall corner and second position pressed into said wall corner, said corner piece including means for attachment to the fabric wall covering and a third lock member for interengagement with said first lock member to retain said corner piece in said second position.

18. The combination of claim 17 wherein said bracket base includes raised channel opposite ends to fit over said horizontal and vertical track base strips at said wall corner.

19. The combination of claim 17 wherein said corner piece includes a raised channel shape to fit over said horizontal and vertical track base strips at said wall corner.

* * * * *